US011305568B2

(12) United States Patent
Wang et al.

(10) Patent No.: US 11,305,568 B2
(45) Date of Patent: Apr. 19, 2022

(54) LOCK PINS FOR CARRIAGE ASSEMBLIES OF PRINTING DEVICES

(71) Applicant: HEWLETT-PACKARD DEVELOPMENT COMPANY, L.P., Spring, TX (US)

(72) Inventors: Deyang Wang, Singapore (SG); Bryan Delima Yrogirog, Singapore (SG); Cherng Linn Teo, Singapore (SG); Adnil San Sazon, Singapore (SG); Wen Xuan Chew, Singapore (SG); Swee Guan Simon Tan, Singapore (SG); Ging Zhao Chen, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/500,367

(22) PCT Filed: Jun. 29, 2018

(86) PCT No.: PCT/US2018/040369

§ 371 (c)(1),
(2) Date: Oct. 2, 2019

(87) PCT Pub. No.: WO2020/005282

PCT Pub. Date: Jan. 2, 2020

(65) Prior Publication Data

US 2021/0331504 A1 Oct. 28, 2021

(51) Int. Cl.

| | |
|---|---|
| ***B41J 29/54*** | (2006.01) |
| ***B41J 2/175*** | (2006.01) |
| ***B41J 29/02*** | (2006.01) |

(52) U.S. Cl.

CPC ..... *B41J 29/54* (2013.01); *B41J 2/1752* (2013.01); *B41J 2/1755* (2013.01); *B41J 29/02* (2013.01)

(58) Field of Classification Search

CPC . B41J 29/54; B41J 29/02; B41J 2/1755; B41J 2/1752; B41J 29/023; B41J 29/026; B41J 29/04; B41J 29/06; B41J 29/08; B41J 29/10; B41J 29/12; B41J 29/13; B41J 29/14; B41J 29/15

See application file for complete search history.

(56) References Cited

U.S. PATENT DOCUMENTS

| | | | |
|---|---|---|---|
| 5,506,611 | A | 4/1996 | Ujita et al. |
| 6,471,334 | B2 | 10/2002 | Kline et al. |
| 7,452,063 | B2 | 11/2008 | Harada et al. |

(Continued)

FOREIGN PATENT DOCUMENTS

| | | | |
|---|---|---|---|
| WO | WO2018018580 | A1 | 2/2018 |

*Primary Examiner* — Kristal Feggins

(74) *Attorney, Agent, or Firm* — Perry + Currier Inc

(57) ABSTRACT

Examples techniques to restrict unlatching of manifolds of carriage assemblies in printing devices are described. In an example, a carriage assembly of a printing device comprises a carriage structure defining an opening to house a printhead and a manifold coupled to the carriage structure. The manifold covers the printhead in a latched position and allows access to the integrated printhead in an unlatched position. A lock pin is mounted on the carriage structure, the lock pin being slideable to a first position and a second position with respect to the manifold along the carriage structure. In an example, the lock pin restricts unlatching of the manifold with the carriage structure in the second position.

15 Claims, 18 Drawing Sheets

(56) References Cited

U.S. PATENT DOCUMENTS

| | | | |
|---|---|---|---|
| 7,896,464 | B2 | 3/2011 | Long et al. |
| 9,409,406 | B2 | 8/2016 | Kimura et al. |
| 2005/0157040 | A1 | 7/2005 | Silverbrook et al. |
| 2011/0025738 | A1 | 2/2011 | Rosati et al. |

LOCK PINS FOR CARRIAGE ASSEMBLIES OF PRINTING DEVICES

BACKGROUND

Printing devices, such as printers, scanners, and photocopiers, often employ inkjet printing techniques to print content on print media. Inkjet printing, generally, involves excitation of print material to eject droplets of print material through printheads of a printing device onto a print medium.

In a printing device using inkjet printing techniques, the printheads are mounted on a carriage which exhibits a reciprocatory motion across a width of the print medium as the print medium is advanced through the printing device. To allow the printing device to print content in various colors, in addition to black, the printheads may eject inks of each of the primary colors, cyan, magenta, and yellow by way of non-limiting example.

BRIEF DESCRIPTION OF FIGURES

The following detailed description references the drawings, wherein.

DETAILED DESCRIPTION

Figure 1A:
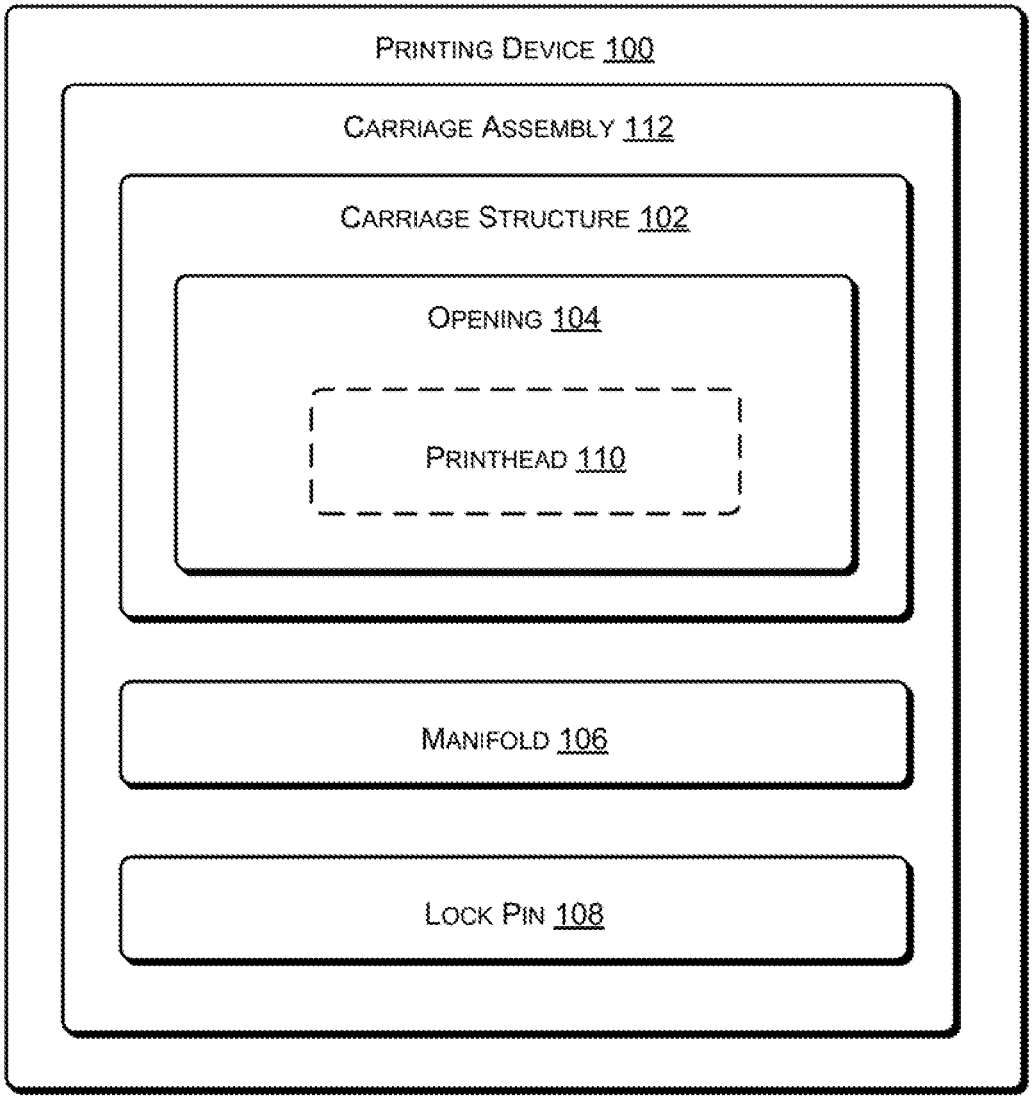
FIG. 1A illustrates a printing device, in accordance with an example implementation of the present subject matter.

Printing devices, such as printers and photocopying devices include printheads to print content on print medium. A printhead is mounted on a carriage of a printing device which reciprocates across a width of the print medium as the print medium is advanced through the printing device. The printhead comprises an print material reservoir that stores print material and nozzles that eject droplets of print material on the print media during the printing process. As the printhead is mounted on the carriage, the print material reservoir in the printhead may be limited in size.

A continuous ink supply system (CISS) supplies print material to the printhead to replenish the print material reservoir, such that frequent replacement of the printhead is avoided. The CISS may supply the print material from an print material tank that may be present within the printing device or from an external print material tank, for example. To provide a continuous supply of print material from the print material tank to the printhead, the CISS comprises various components, such as print material supply tubes and a manifold. The print material supply tubes deliver print material from the print material tank while the manifold provides for latching of the print material supply tubes with the print material reservoirs in the printhead to establish fluid connectivity therebetween. The manifold also provides an air seal between the print material supply tubes and the printhead.

Frequent opening and closing of the manifold may lead to entrainment of air in the print material supply tubes causing print material starvation in the printhead. Accordingly, frequent opening and closing of the manifold, for example, when no servicing is to be performed on the printhead, is avoided to ensure longevity of the printhead. Generally, unlatching of the manifold may be restricted by a controller of a printing device (e.g., a processor of a printing device). For example, the controller may allow opening of the manifold when it detects malfunctioning of the printhead and not otherwise. However, such an operation of the controller may not be effective in various situations, for example, when a power supply to the controller is unavailable.

According to examples of the present subject matter, techniques to restrict unlatching of the manifold are described. According to the present subject matter, a printing device comprising a carriage assembly to move relative to a print media. The carriage assembly comprises a carriage structure defining an opening to house a printhead and a manifold coupled to the carriage structure. The manifold covers the printhead in a latched position and allows access to the printhead in an unlatched position. In accordance with example implementations of the present subject matter, a lock pin is mounted on the carriage structure. The lock pin is slideable, on the carriage structure, to a first position and a second position with respect to the manifold. In an example, the lock pin is automatically slidable to the second position where the lock pin restricts unlatching of the manifold from the carriage structure to uncover the opening that houses the printhead.

In accordance with example implementations of the present subject matter, locking of the manifold with the carriage structure provides for preventing frequent unlatching, such as accidental unlatching of the manifold. Further, the lock pin being simple in design is easy to construct and implement in the printing device and does not affect the cost or operation of the printing device.

The present subject matter is further described with reference to FIGS. 1A to 15. It should be noted that the description and figures merely illustrate principles of the present subject matter. Various arrangements may be devised that, although not explicitly described or shown herein, encompass the principles of the present subject matter. Moreover, all statements herein reciting principles, aspects, and examples of the present subject matter, as well as specific examples thereof, are intended to encompass equivalents thereof.

FIG. 1A shows a printing device 100, according to an example implementation of the present subject matter. Examples of the printing device 100 include, but are not limited to, printers, photocopier, scanners, plotters and other devices which comprise printheads or pens to print content on a print medium. Examples of the print medium include, paper, cloth, plastics, and fabric.

The printing device 100 comprises a carriage assembly 112 that moves within the printing device 100, for instance, relative to a print media. The carriage assembly 112 comprises a carriage structure 102 which defines an opening 104 to house a printhead 110. The structure of the carriage assembly 112 has been elaborated in reference to FIG. 1B subsequently.

The printhead 110 is responsive to activation signals from the printing device 100 to deposit print material on the print medium. The printhead 110 comprises nozzles (not shown) to eject tiny droplets of print material onto the print medium and an print material reservoir that stores the ink. In an example, the printhead 110 may include a single print material reservoir, for example, to carry black colored print material to allow monochrome printing. In another example, the printhead 110 may include more print material reservoirs, for instance, three print material reservoirs to hold print material of primary colors, namely, cyan, magenta, and yellow to enable the printing device 100 to print content in various hues.

In an example, the printing device 100 may be a 3D printer that may print three dimensional objects based on an additive manufacturing process. In such example cases, the printhead 110 may comprise nozzles to extrude print material, such as colorants and/or binding agents.

While the example implementation illustrated in FIG. 1A describes a single printhead 110, it will be understood that the printing device 100 may comprise more than one printheads. For example, the printing device 100 may comprise two printheads where one of the printhead carries black print material and the other carries cyan, magenta, and yellow ink. Also, as will be understood, the number of openings 104 correspond with the number of printheads incorporated in the printing device 100.

A manifold 106 is coupled to the carriage structure 102. In an example, the manifold 106 is positioned such that it covers a portion of the opening 104 of the carriage structure 102. When the printhead 110 is placed in the opening 104, the manifold 106 covers the printhead 110. The manifold 106 may be detachably latched to the carriage structure 102. In a latched position of the manifold 106, the manifold 106 covers the printhead 110 and does not allow access to the printhead 110. Likewise, in an unlatched position, the manifold 106 does not cover the opening 104 and the printhead 110 may be accessed.

In an example, the printing device 100 comprises a lock pin 108. The lock pin 108 is slidably mounted on the carriage structure 102 such that the lock pin 108 is movable to a first position and a second position with respect to the manifold 106 along the carriage structure 102. In an example implementation, in the second position of the lock pin 108 with respect to the manifold 106, the lock pin 108 restricts the unlatching of the manifold 106 with the carriage structure 102 once the two have latched. Detailed operation and structure of the lock pin 108 is elaborated subsequently.

Figure 11:
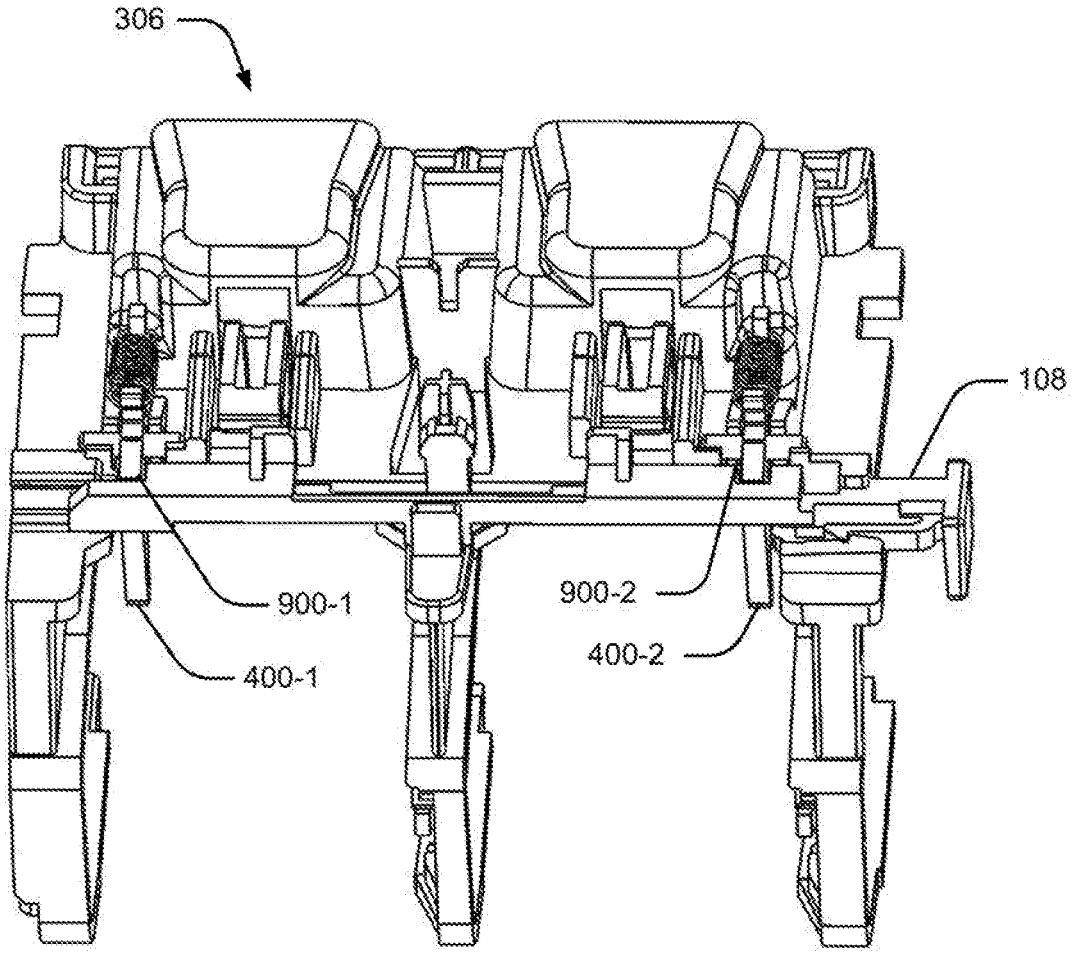
FIG. 11 illustrates the chute assembly with the lock pin, in accordance with an example implementation of the present subject matter.

To explain the structure of the carriage assembly 112, reference is made to FIG. 11 that illustrates the carriage assembly 112 of the printing device 100, in accordance with an example implementation of the present subject matter. As mentioned in context of FIG. 1A above, the carriage assembly 112 comprises the carriage structure 102, the manifold 106 and the lock pin 108 (not shown in FIG. 1B) that may allow locking of the manifold 106 with the carriage structure 102.

Figure 1B:
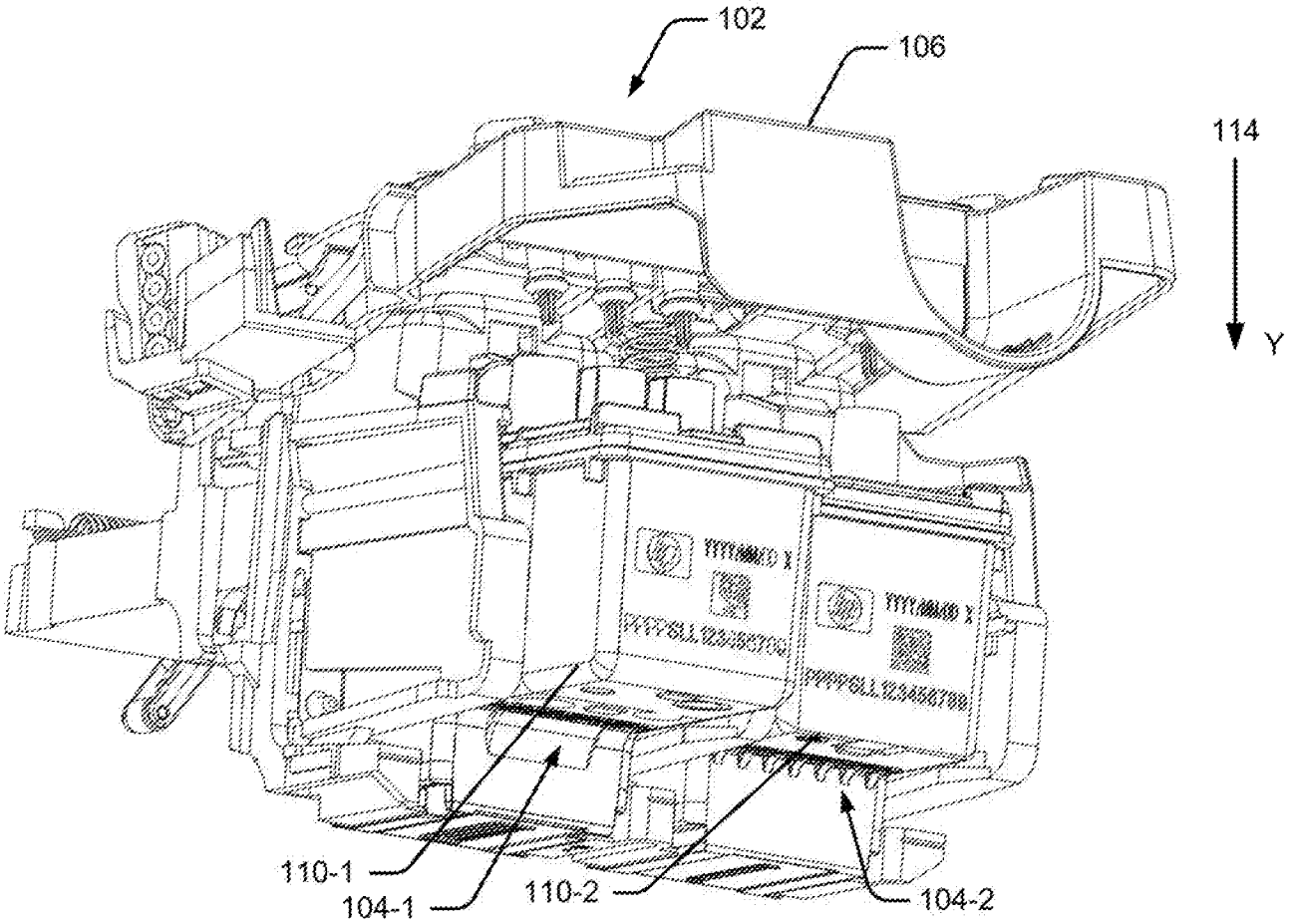
FIG. 1B illustrates a carriage assembly of the printing device, in accordance with an example implementation of the present subject matter.

In the example implementation illustrated in FIG. 1B, printheads 110-1 and 110-2 are shown inserted into openings 104-1 and 104-2, respectively, of the carriage structure 102. Also, in the example implementation illustrated in FIG. 1B, the manifold 106 is in the above-mentioned unlatched position and the manifold 106 does not cover the openings 104-1 and 104-2, such that the printheads 110-1 and 110-2 may be accessed by a user. In contrast, FIG. 3, described subsequently, shows the manifold 106 in the latched position where the manifold 106 may cover the printheads 110-1 and 110-2 and block access to them. In an example, a downward movement of the manifold 106 towards the carriage structure 102 in a Y direction, as depicted by arrow 114, moves the manifold 106 from the unlatched position to the latched position.

Thus, the manifold 106 is detachably latched to the carriage structure 102 and the manifold 106 may be moved from the latched position to the unlatched position to access the printheads 110-1 and 110-2. In an example, once the printheads 110-1 and 110-2 are installed in the respective openings 104-1 and 104-2 and the manifold 106 is latched with the carriage structure 102, the lock pin 108 (not shown in FIG. 1B) may restrict the manifold 106 from moving to the unlatched position.

In an example implementation, when the unlatching of manifold 106 with the carriage structure 102 is restricted, the manifold 106 may be said to be locked with the carriage structure 102, thereby blocking access to the printhead 110. In an example, the manifold 106 may be unlocked to allow unlatching of the manifold 106 with the carriage structure 102. The unlocking involves sliding of the lock pin 108 to the first position from the second position. While the manifold 106 may be unlocked, for example, for replacing or repairing the printhead 110, maintaining the lock pin 108 in the second position restricts frequent unlatching, such as accidental unlatching of the manifold 106. Minimizing instances of unlatching of the manifold 106 enables uninterrupted working of a CISS of the printing device 100.

Figure 2:
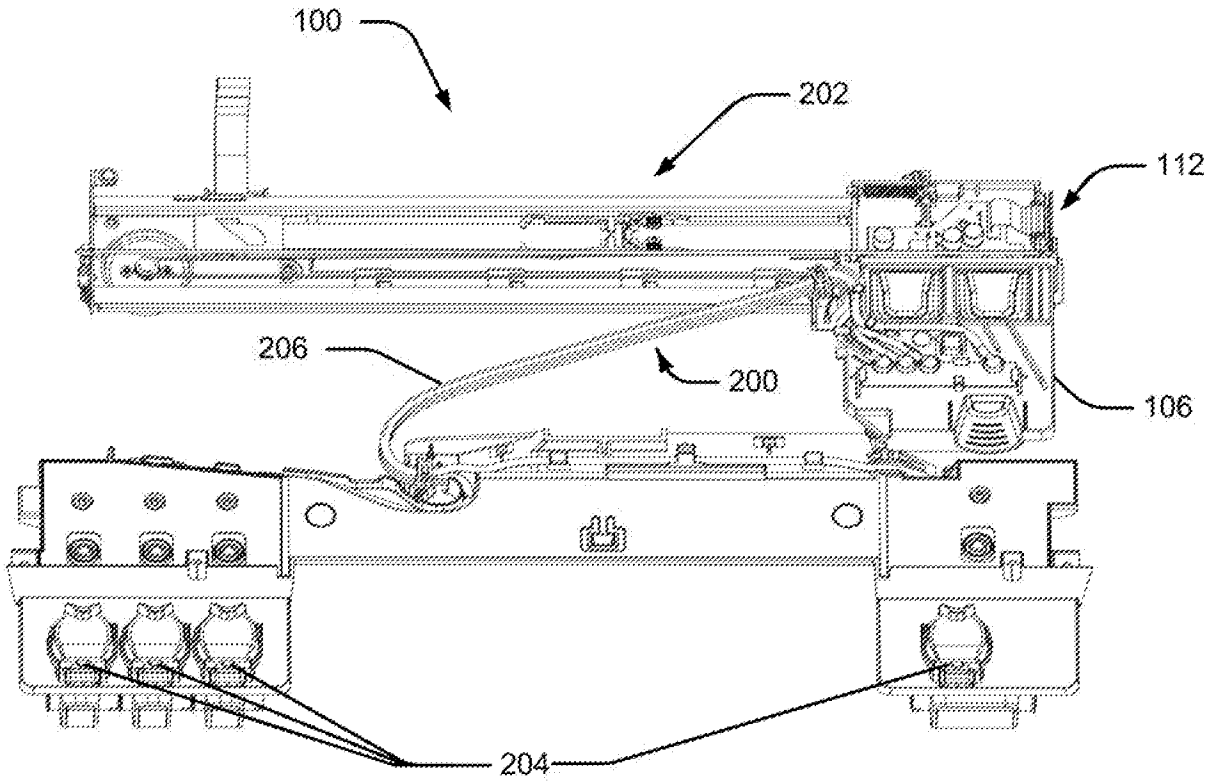
FIG. 2 illustrates a continuous ink supply system (CISS) of the printing device, in accordance with an example implementation of the present subject matter.

FIG. 2 illustrates a CISS 200 of the printing device 100, according to an example implementation of the present subject matter. The description of FIG. 2 refers to elements of the carriage assembly 112 described with regard to FIG. 1A and FIG. 1B (e.g., the carriage structure 102, openings 104-1 and 104-2, printheads 110-1 and 110-2, and lock pin 108) that are not visible in FIG. 2.

As mentioned above, the printheads 110-1 and 110-2 of the printing device 100 are mounted on the carriage assembly 112. The carriage assembly 112 hinges on a hanger assembly 202 of the printing device 100 which supports the carriage assembly 112, along with the printhead 110 and allows a movement of the carriage assembly 112 in a print zone of the printing device 100.

The CISS 200 delivers print material to the printheads 110-1 and 110-2 from print material tanks 204 of the printing device 100. The CISS 200 comprises print material supply tubes 206 that are connected to one of the printheads 110-1 and 110-2 at one end and to one of the print material tanks 204 at another end. Cavities (not shown) on the manifold 106 allow the print material supply tubes 206 to be inserted into print material reservoirs of the corresponding printhead 110-1 or 110-2.

In an initial process of setting up the printing device 100 for operation, the printheads 110-1 and 110-2 are inserted into the openings 104-1 and 104-2, respectively, in the carriage structure 102. To allow insertion of the printheads 110-1 and 110-2 in the openings 104-1 and 104-2, the manifold 106 is in the unlatched position where it does not cover the openings 104-1 and 104-2. Once the printheads 110-1 and 110-2 are inserted into the openings 104-1 and 104-2, the manifold 106 may be latched to the carriage structure 102 and the print material supply tubes 206 may be coupled with the corresponding printhead 110-1 or 110-2. In the latched position, the manifold 106 also serves to provide an air seal between the print material supply tubes 206 and the printheads 110-1 and 110-2 to prevent air from entering into the print material supply tubes 206 or the printheads 110-1 and 110-2.

The manifold 106 is maintained in the latched position for uninterrupted print material supply to the printheads 110-1 and 110-2 as unlatching of the manifold 106 from the carriage structure 102 may disrupt the operation of the CISS 200. In an example, the above-described lock pin 108 provides to maintain the latching of the manifold 106 with the carriage structure 102 until a conspicuous unlocking action is performed by a user thereby avoiding any inadvertent unlatching of the manifold 106.

Figure 3:
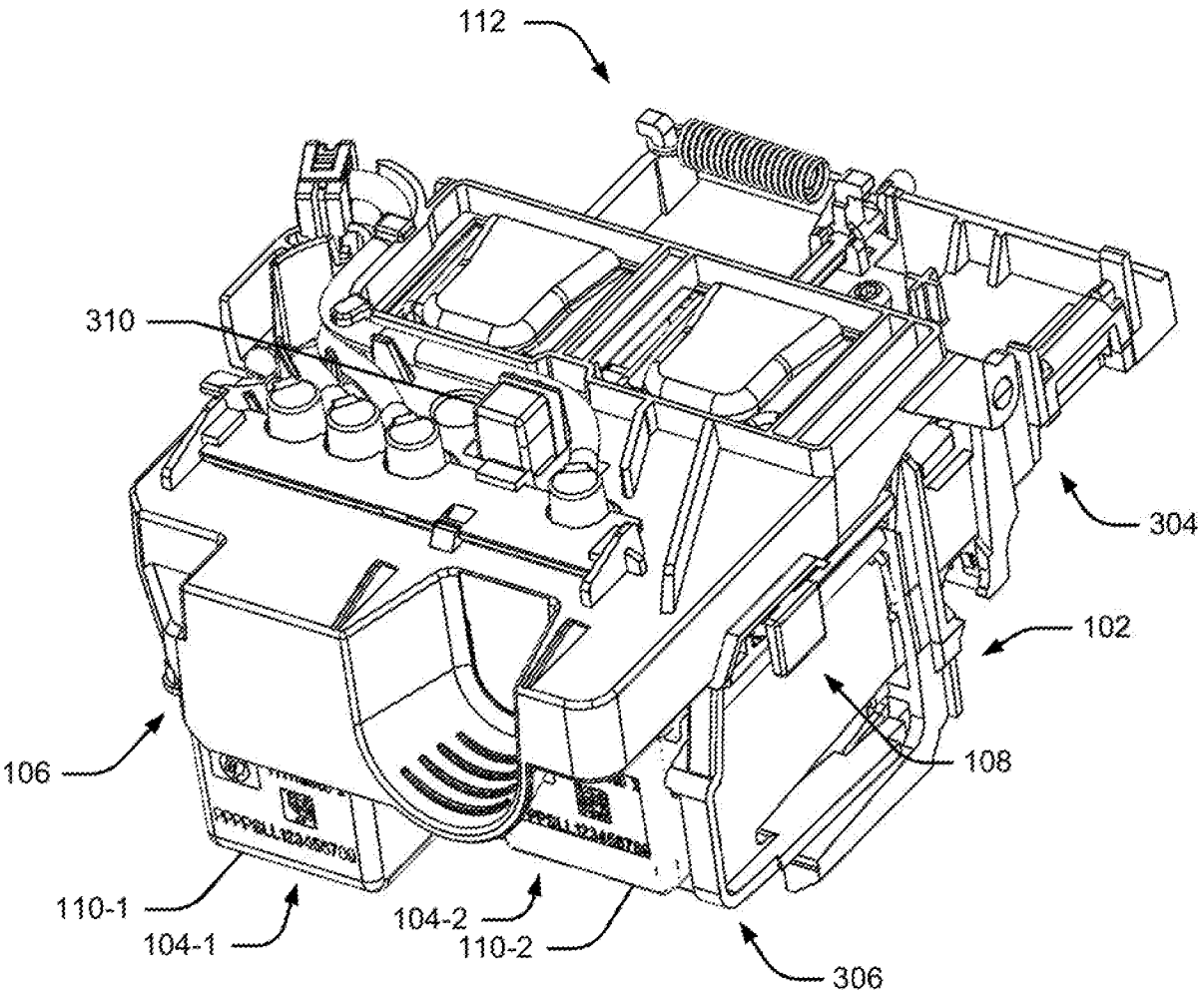
FIG. 3 shows a carriage assembly of the printing device, in accordance with an example implementation of the present subject matter.

FIG. 3 shows the carriage assembly 112 of the printing device 100, according to another example implementation of the present subject matter. In the example implementation illustrated in FIG. 3, the manifold 106 is in the latched position.

Figure 5:
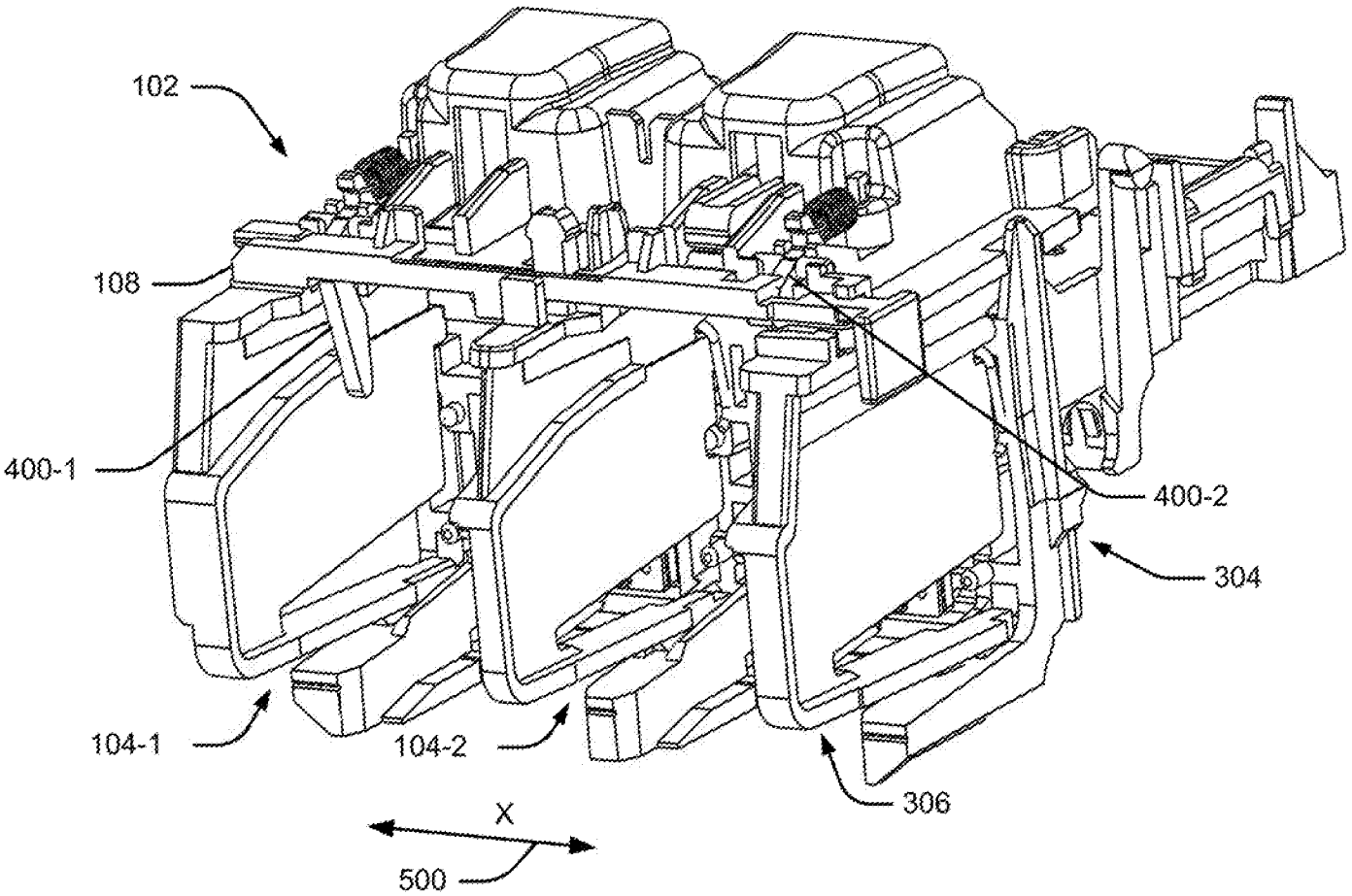
FIG. 5 illustrates a carriage structure of the printing device, in accordance with an example implementation of the present subject matter.

The carriage assembly 112 comprises the carriage structure 102 and the manifold 106, as mentioned above. The carriage structure 102 in turn comprises a carriage base 304 and a chute assembly 306 attached to the carriage base 304. As illustrated in the example implementation of FIG. 3, the chute assembly 306 of the carriage structure 102 has the openings 104-1 and 104-2 with the printheads 110-1 and 110-2 located therein. The openings 104-1 and 104-2 of the chute assembly 306, without the printheads 110-1 and 110-2, are depicted in FIG. 5. As mentioned earlier, the number of openings 104 correspond with the number of printheads incorporated in the printing device 100. Accordingly, in example implementations where the printing device 100 incorporates the single printhead 110, the chute assembly 306 has the opening 104 alone.

The carriage base 304 supports the printheads 110-1 and 110-2 for them to be mounted on the hanger assembly 202 (shown in FIG. 2). The manifold 106 is coupled to the carriage base 304 to cover the printheads 110-1 and 110-2 in the latched position and allow access to the printheads 110-1 and 110-2 in the unlatched position. For the purpose, the carriage assembly 112 comprises a latching device 310. In an example, the latching device 310 latches the manifold 106 with the carriage base 304 upon a first downward movement of the manifold 106 towards the carriage base 304 and unlatches the manifold 106 from the carriage base 304 on a second downward movement of the manifold 106 towards the carriage base 304. Reference may be made to FIG. 1B depicting the direction of the first downward movement and second downward movement of the manifold 106 towards the carriage structure 102 using the arrow 114. In an example, the latching device 310 is a push-push latch (elaborated later).

In an example implementation, the lock pin 108 is mounted on the chute assembly 306. The lock pin 108 is slidable to the first position with respect to the manifold 106 and the second position with respect to the manifold 106 on the chute assembly 306. For instance, the direction of the sliding movement of the lock pin 108 on the chute assembly 306 is along a length of the chute assembly 306 in the left-to-right direction (depicted in FIG. 5). In an example, in the second position, the lock pin 108 restricts the second downward movement of the manifold 106 towards the carriage base 304 as a result of which the manifold 106 may not be unlatched from the carriage base 304.

Figure 4:
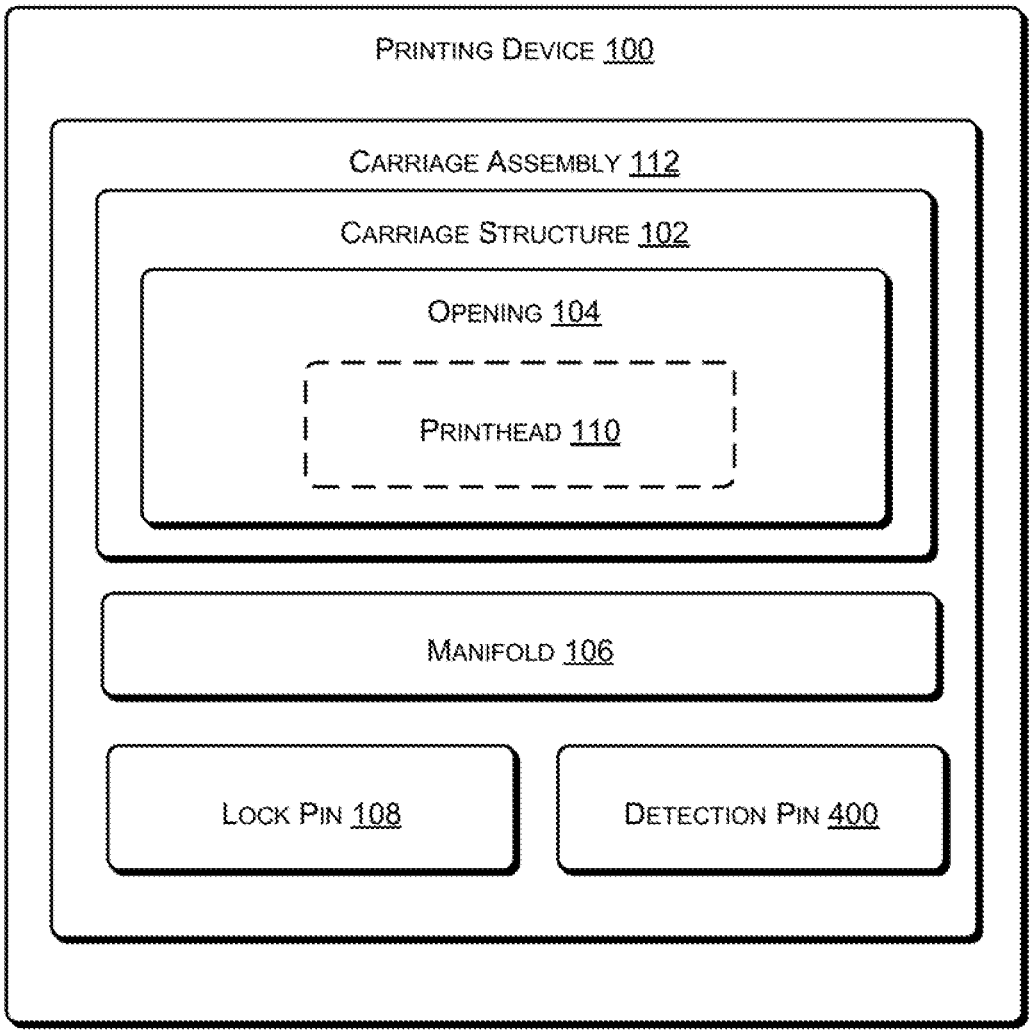
FIG. 4 illustrates the printing device, according to another example implementation of the present subject matter.

FIG. 4 shows the printing device 100, according to another example implementation of the present subject matter. The printing device 100 comprises the carriage assembly 112 which moves within the printing device 100. The carriage assembly 112 comprises the carriage structure 102 having the opening 104 for housing the printhead 110 and the manifold 106 to latch and unlatch with the carriage structure 102 on the first and second downward movement of the manifold 106, respectively, towards the carriage structure 102. The lock pin 108 is slideable on the carriage structure 102 to the first position and the second position with respect to the manifold 106. The lock pin 108 allows unlatching of the manifold 106 with the carriage structure 102 when stationed at first position and blocks unlatching of the manifold 106 when in the second position.

Further, in accordance with an example implementation of the present subject matter, the carriage assembly 112 comprises a detection pin 400 mounted on the carriage structure 102. In the first position of the lock pin 108, the detection pin 400 engages with the lock pin 108 to restrict its sliding to the second position. Detailed description of the detection pin 400 is provided later in the present description.

FIG. 5 illustrates the carriage structure 102 of the printing device 100 in accordance with an example implementation of the present subject matter. The carriage structure 102 comprises the chute assembly 306 attached to the carriage base 304. In an example, the lock pin 108 is slidably mounted on the chute assembly 306. In an example implementation, the sliding movement of the lock pin 108 on the chute assembly 306 is along the length of the chute assembly 306 in a X direction as depicted by arrow 500.

Also, the chute assembly 306 comprises two openings 104-1 and 104-2 to accommodate a printhead in each of the openings 104-1 and 104-2. Two detection pins 400-1 and 400-2 are mounted on the chute assembly 306. As can be seen in the example implementation illustrated in FIG. 5, the detection pins 400-1 and 400-2 are mounted on the chute assembly 306, such that a portion of the detection pins 400-1 and 400-2 is located in the openings 104-1 and 104-2, respectively. The detection pins 400-1 and 400-2 move within the openings 104-1 and 104-2, upon insertion of the printheads 110-1 and 110-2 in the openings 104-1 and 104-2, respectively.

Figure 6:
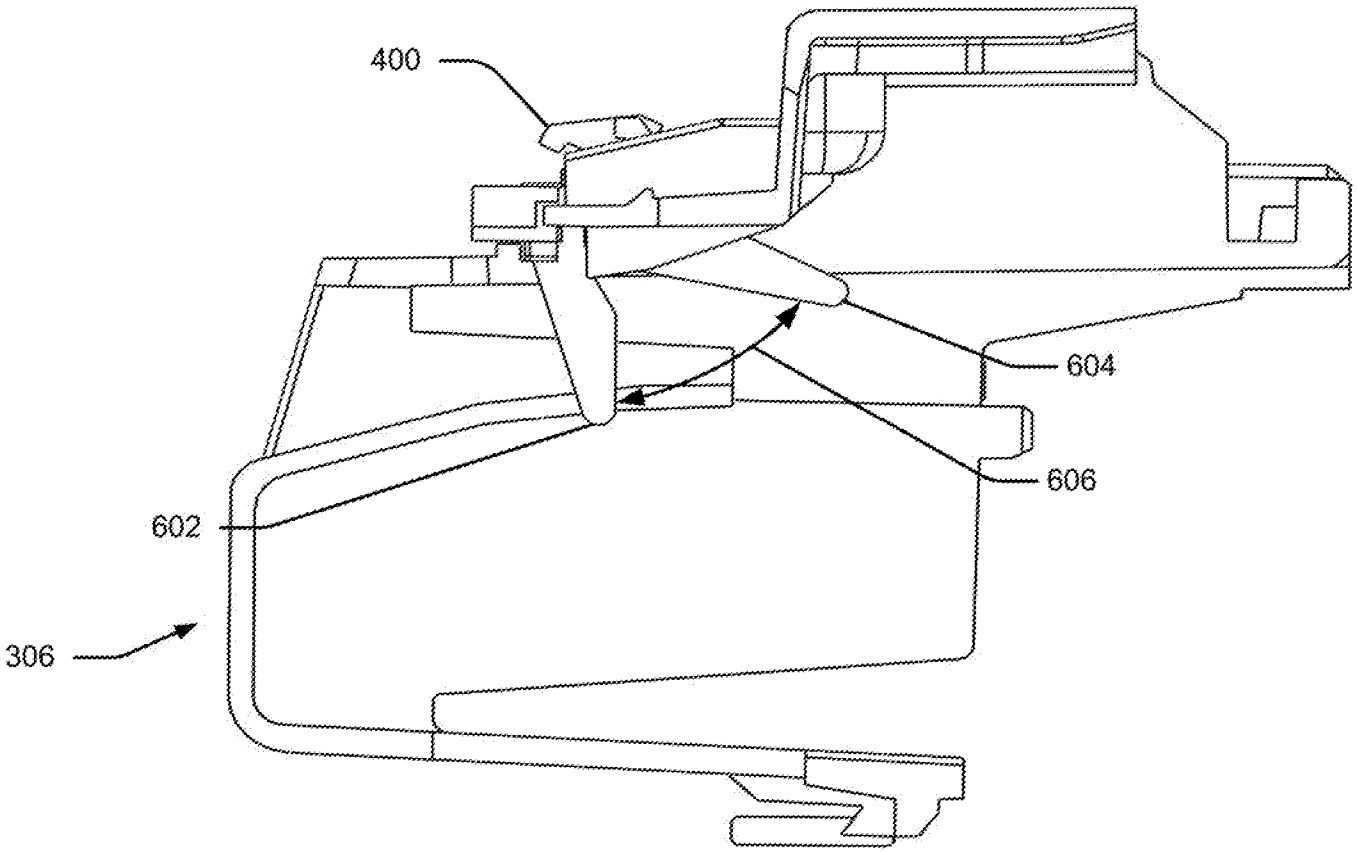
FIG. 6 illustrates a detection pin provided in a chute assembly, in accordance with an example implementation of the present subject matter.

To explain the movement of the detection pin 400 in an opening 104, reference is made to FIG. 6 which illustrates the detection pin 400 provided in the chute assembly 306 in accordance with an example implementation of the present subject matter. When no printhead 110 is present in the opening 104, the detection pin 400 is in a block position 602 and when a printhead 110 is inserted in the opening 104, to accommodate the printhead 110, the detection pin 400 moves to a release position 604.

In an example, the movement of the detection pin 400 is inwards and outwards in the opening 104 in a direction depicted by arrow 606. In an example, the movement of the detection pin 400 is perpendicular to the direction of the movement of the lock pin 108. In other words, if the direction of the movement of the lock pin 108 is considered to be the X direction as depicted by arrow 500 in FIG. 5, the direction of the movement of the detection pin 400 may be in a Z direction with respect to the direction of the movement of the lock pin 108.

In an example, in the block position 602, the detection pin 400 engages with the lock pin 108 in the first position of the lock pin 108 to restrict the lock pin 108 from sliding to the second position. The subsequent description provides details relating to the detection pin 400 and the lock pin 108 to explain their engagement and operation to restrict the unlatching of the manifold 106.

Figure 7:
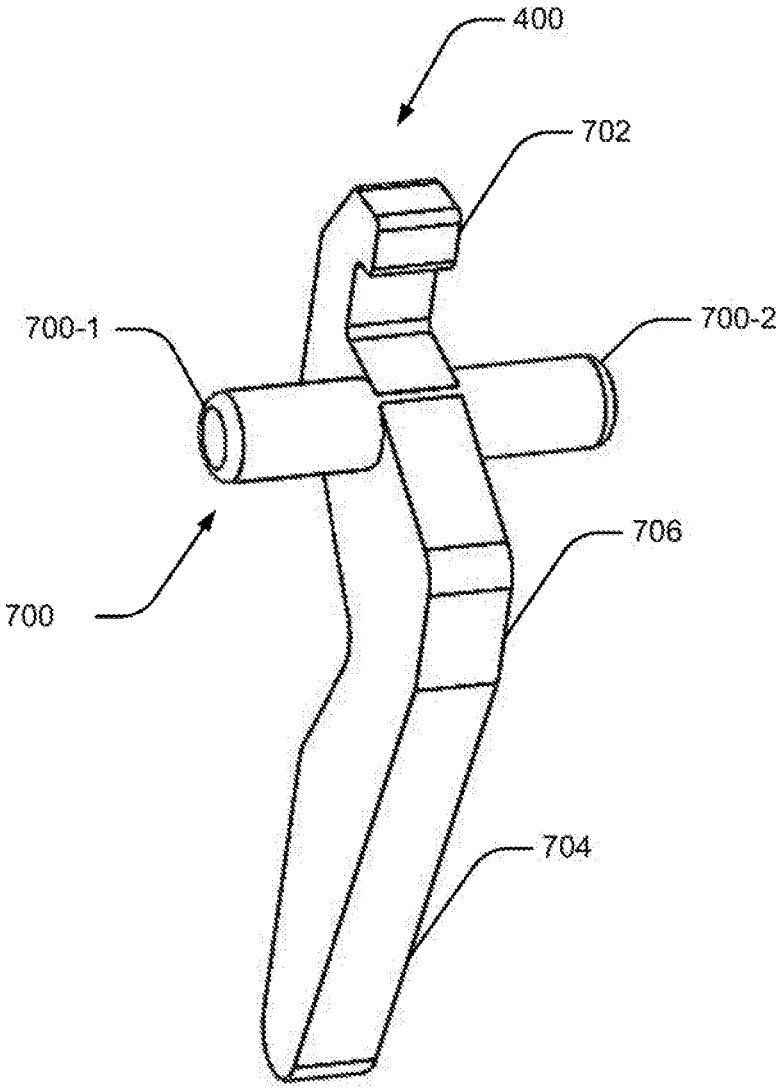
FIG. 7 illustrates the detection pin, in accordance with another example implementation of the present subject matter.

FIG. 7 illustrates the detection pin 400 in accordance with an example implementation of the present subject matter. In an example, the detection pin 400 comprises a holding arm 700, a hook 702, a pin 704 and a lock stopper 706. In an example, the hook 702, the pin 704 and the lock stopper 706 are part of a body of the detection pin 400 while the holding arm 700 comprises arm projections 700-1 and 700-2 on either side of the body of the detection pin 400.

Figure 8:
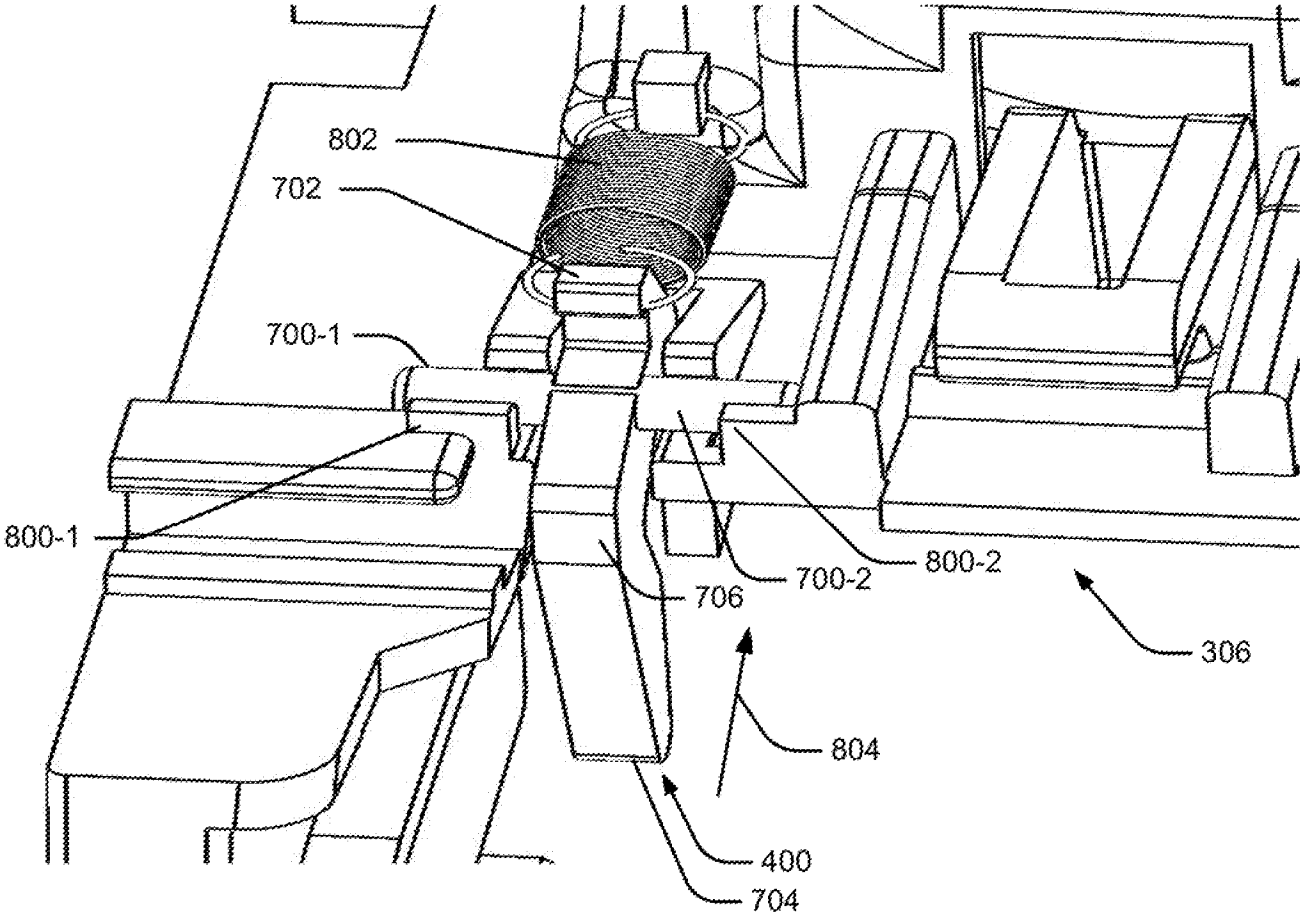
FIG. 8 illustrates the detection pin, in accordance with yet another example implementation of the present subject matter.

FIG. 8 illustrates the detection pin 400 to depict coupling of the detection pin 400 with the chute assembly 306 in accordance with another example implementation. In an example, the holding arm 700 of the detection pin 400 may be rotatably attached to the chute assembly 306. In an example, the arm projections 700-1 and 700-2 of the holding arm 700 abuts along their circumference against chute projections 800-1 and 800-2 provided on the chute assembly 306.

In case no printhead 110 is present in the opening 104, the pin 704 of the detection pin 400 is in a position corresponding to the above-explained block position 602 (shown in FIG. 6). The printhead 110 and the opening 104 are not depicted in FIG. 8, however, reference may be made to previously explained FIG. 5 and FIG. 6 for these components. When a printhead 110 is inserted in the opening 104, the pin 704 is pushed into the opening 104 in the Z direction, depicted by arrow 804 (similar to arrow 606 shown in FIG. 6), by the printhead 110. The holding arm 700 being rotatably mounted on the chute assembly 306 allow the pin 704 to move inwards in the opening 104, to a position corresponding to the above-explained release position 604.

In an example, a spring 802 is mounted on the chute assembly 306. The spring 802 is coupled to the hook 702 of the detection pin 400-1 to move the detection pin 400 to the block position 602 upon removal of the printhead 110 from the opening 104. Thus, the spring 802 biases the detection pin 400 in the block position 602. In an example, a spring constant of the spring 802 is such that the pin 704 of the detection pin 400 is pushed to the block position 602 upon removal of the printhead 110 from the opening 104 and yet the insertion of the printhead 110 into the opening 104 is not hindered. In other words, the spring constant of the spring 802 is such the detection pin 400 does not offer excess resistance to a user inserting the printhead 110 into the opening 104.

As will be apparent from the foregoing description, the block position 602 of the detection pin 400 corresponds to the first position of the lock pin 108, in which the detection pin 400 engages with the lock pin 108 to restrict a sliding movement of the lock pin 108. In an example, the lock stopper 706 of the detection pin 400-1 engages with the lock pin 108 in the first position of the lock pin 108.

Figure 9:
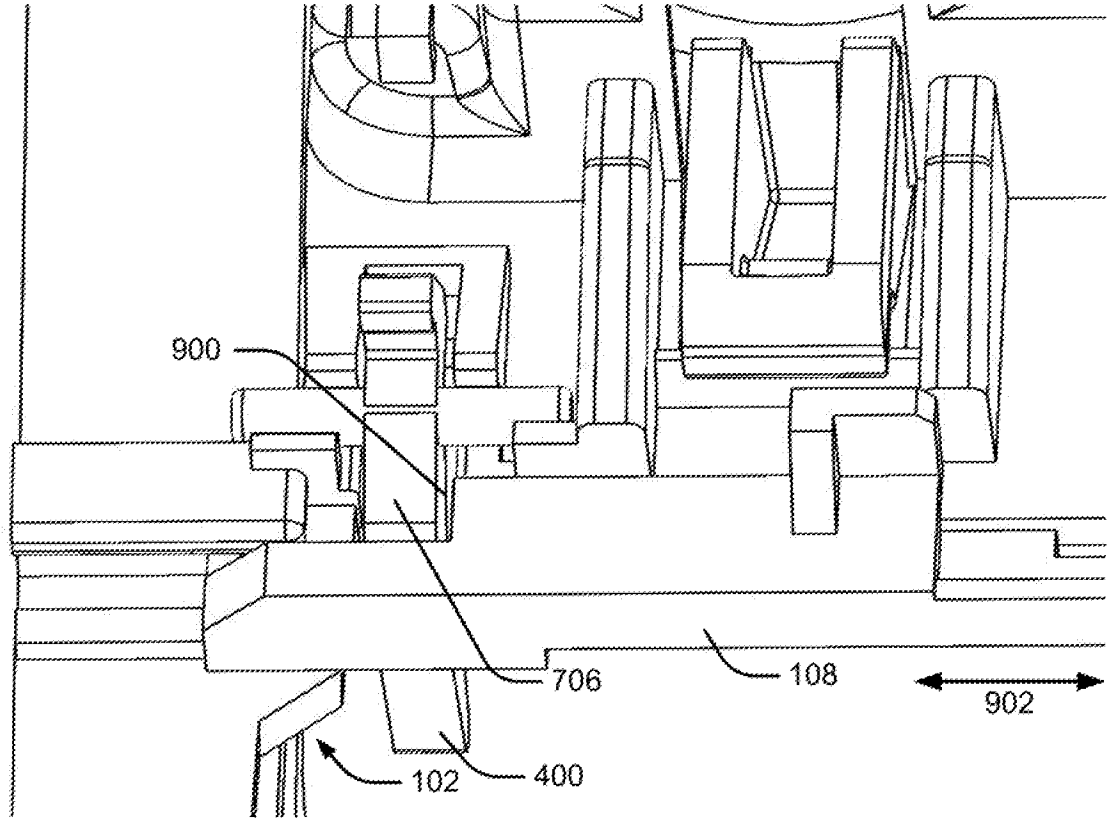
FIG. 9 illustrates the detection pin engaged with a lock pin, according to an example implementation of the present subject matter.

Reference is made to FIG. 9 that illustrates the detection pin 400 engaged with the lock pin 108, in accordance with an example implementation of the present subject matter. In the example implementation illustrated in FIG. 9, the detection pin 400 is in the block position 602 (shown in FIG. 6). In the block position 602, the lock stopper 706 of the detection pin 400-1 is accommodated in a slot 900 of the lock pin 108. Since the lock stopper 706 is lodged in the slot 900 of the lock pin 108, the sliding movement of the lock pin 108 in the X direction, shown using arrow 902, is restricted. When the lock stopper 706 is moved out of the slot 900, for example, when the pin 704 of the detection pin 400 is pushed by a printhead 110 and the detection pin 400 moves to the release position 604, the lock pin 108 may slide in the X direction to attain the second position with respect to the manifold 106.

As mentioned previously, in the second position of the lock pin 108, the lock pin 108 locks the manifold 106 to the carriage structure 102 such that the manifold 106 may not be unlatched to access the printhead 110. Details of the locking of the manifold 106 are presented subsequent to the following description of the structure and operation of the lock pin 108.

Figure 10A:
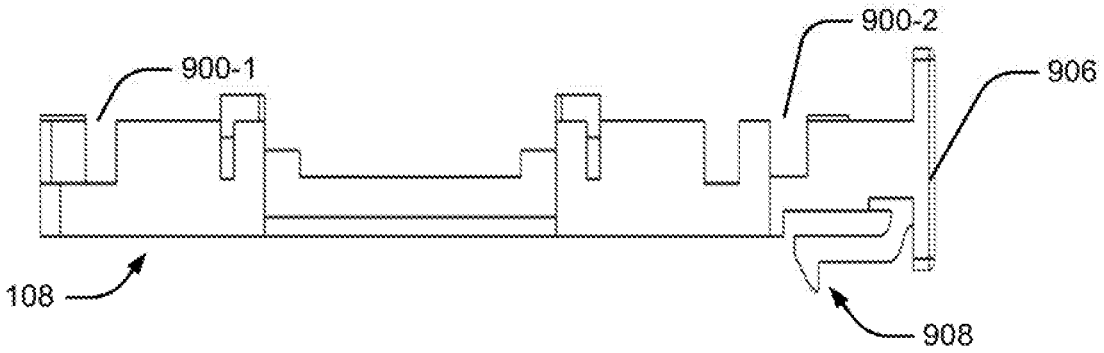
FIGS. 10A and 10B illustrate the lock pin, in accordance with an example implementation of the present subject matter.
Figure 10B:
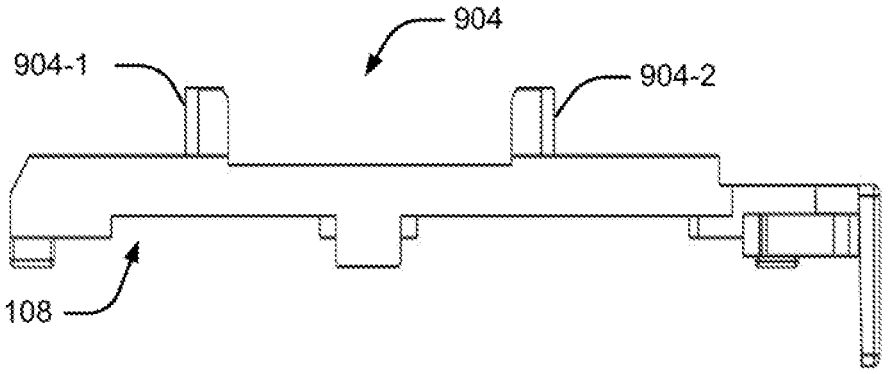

FIGS. 10A and 10B illustrate the lock pin 108, in accordance with an example implementation of the present subject matter. FIGS. 10A and 10B present a top view and a front view of the lock pin 108, respectively, in accordance with an example implementation of the present subject matter. Shown in top view of the lock pin 108 illustrated in FIG. 10A, are slots 900-1 and 900-2 that correspond to the above-mentioned slot 900 of the lock pin 108.

As mentioned earlier, the printing device 100 may include two printheads. It will be appreciated that in example implementations where the printing device 100 includes two printheads, two detection pins 400-1 and 400-2 with one detection pin may be provided to each of the openings 104-1 and 104-2. The foregoing explanation of the detection pin 400 extends to the detection pins 400-1 and 400-2. Accordingly, the slots 900-1 and 900-2 of the lock pin 108 may accommodate the respective pin 704 of the detection pins 400-1 and 400-2 when the lock pin 108 is in the first position.

In an example, the lock pin 108 comprises a latch locker 904. In an example, the latch locker 904 comprises latch projections 904-1 and 904-2. As shown in the front view of the lock pin 108 illustrated in FIG. 10B, the projections 904-1 and 904-2 project in an upward direction, i.e., the Y direction which is towards the manifold 106. As will be elaborated later, in the second position of the lock pin 108, the latch locker 904 interfaces with the manifold 106 to limit the movement of the manifold 106 in the downward direction. Also, elaborated later is an end member 906 of the lock pin 108 that enables the lock pin 108 to move from the first position to the second position and a hooking member 908 of the lock pin 108 that is operable to move the lock pin 108 from the second position to the first position.

FIG. 11 illustrates the chute assembly 306 with the lock pin 108 mounted thereon, in accordance with an example implementation of the present subject matter. In accordance with the example implementation illustrated in FIG. 11, the lock pin 108 is in the first position on the chute assembly 306. As shown, in the first position, the detection pins 400-1 and 400-2 are secured in the slots 900-1 and 900-2 of the lock pin 108. Thus, the detection pins 400-1 and 400-2 restrict the sliding movement of the lock pin 108 in the X direction.

As explained earlier, the lock pin 108 is slidably mounted on the chute assembly 306 and is slidable to the second position where the lock pin 108 locks the manifold 106 with the chute assembly 306. The blocking of the lock pin 108 by the detection pins 400-1 and 400-2 ensures that the lock pin 108 is disabled from sliding to the second position to lock the manifold 106 until both the printheads 110-1 and 110-2 have been mounted on the chute assembly 306. Insertion of the printheads 110-1 and 110-2 in the openings 104-1 and 104-2, respectively, disengage the detection pins 400-1 and 400-2 from the lock pin 108, such that the lock pin 108 is rendered free to slide on the chute assembly 306.

Figure 12A:
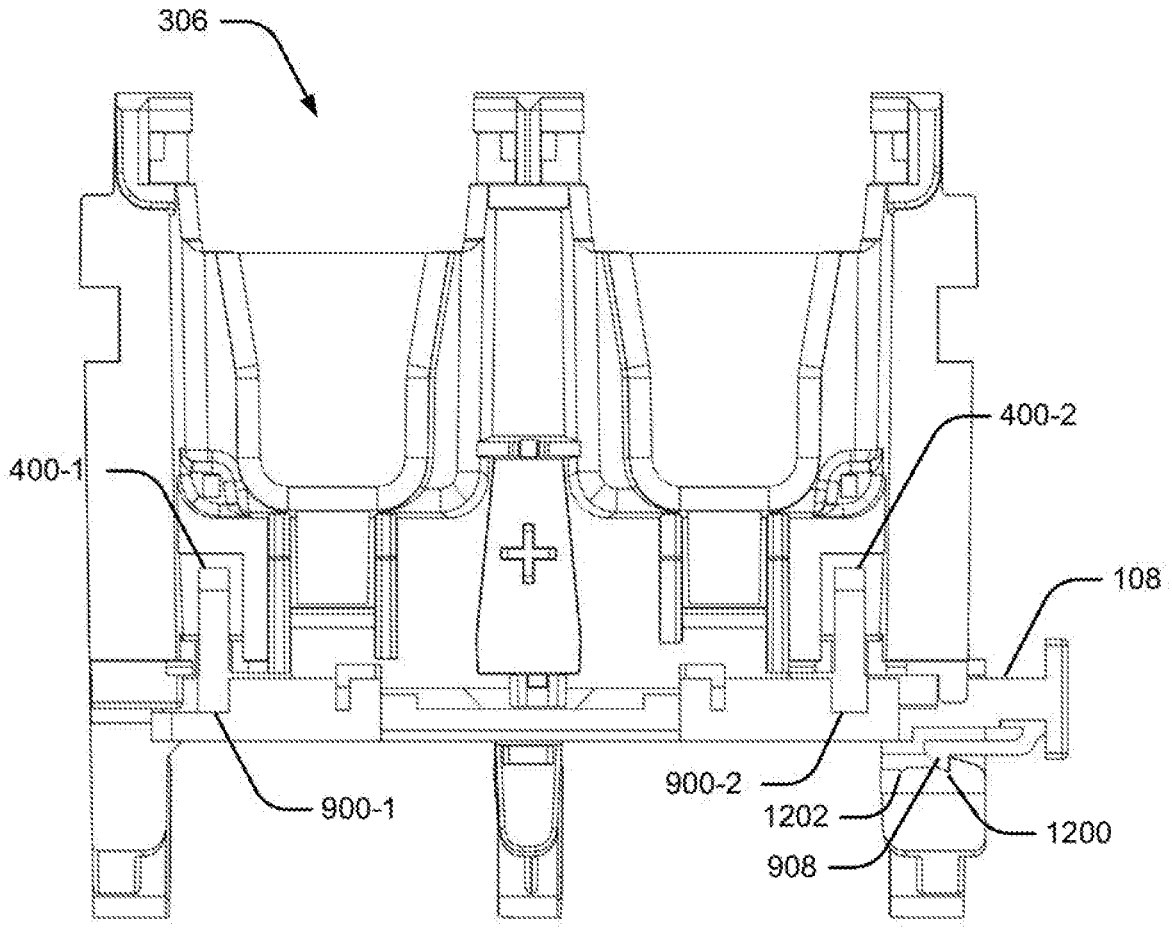
FIGS. 12A and 12B illustrate the lock pin on the chute assembly in a first position and a second position, respectively, in accordance with an example implementation of the present subject matter.
Figure 12B:
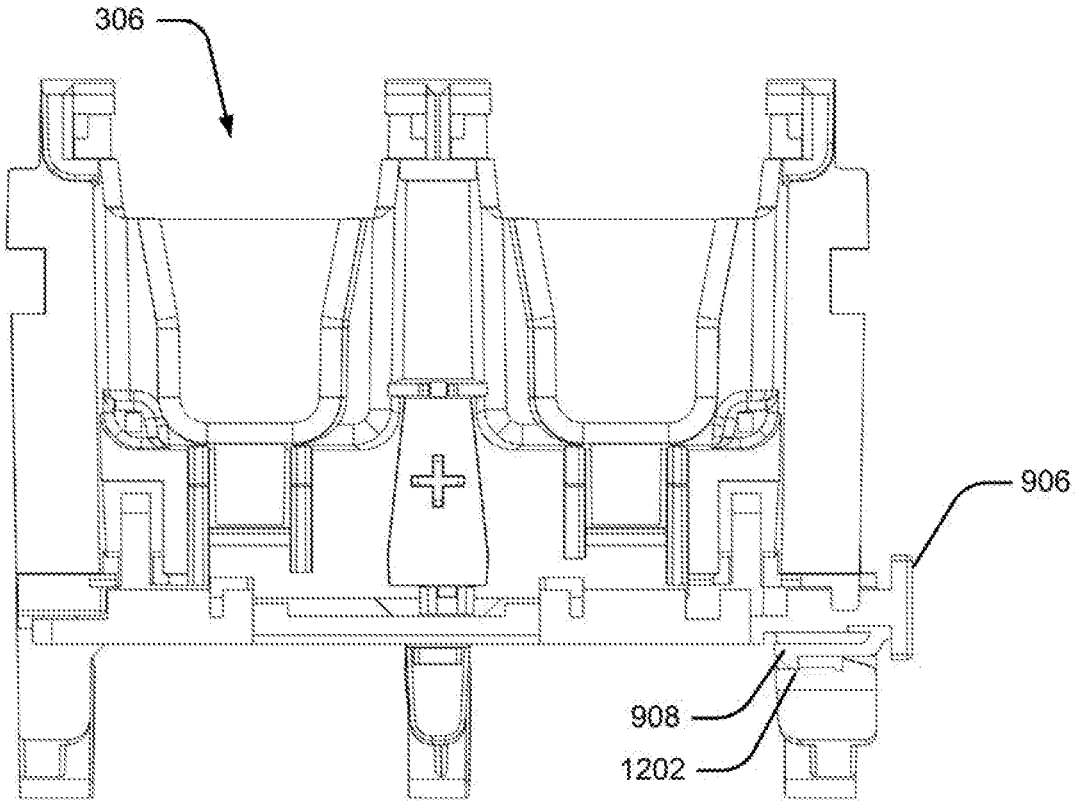

FIGS. 12A and 12B illustrate the lock pin 108 on the chute assembly 306 in the first position and the second position, respectively, in accordance with an example implementation of the present subject matter.

FIG. 12A shows a top view of the lock pin 108 in the first position. As apparent, FIG. 12A provides the top view of the lock pin 108 in the first position corresponding to the front view illustrated in FIG. 11. In the first position of the lock pin 108 shown in FIG. 12A, the detection pins 400-1 and 400-2 are secured in the slots 900-1 and 900-2 of the lock pin 108. The hooking member 908 of the lock pin 108 interfaces with a first projection 1200 provided on the chute assembly 306. In addition to the first projection 1200, a first groove 1202 (elaborated below) is also provided on the chute assembly 306.

When the detection pins 400-1 and 400-2 are disengaged with the lock pin 108, the lock pin 108 may slide on the chute assembly 306. The lock pin 108 may slide to the second position shown in FIG. 12B where the end member 906 of the lock pin 108 is closer to chute assembly 306. In the second position, the hooking member 908 of the lock pin 108 may disengage with the first projection 1200 provided on the chute assembly 306 and rest in the first groove 1202 of the chute assembly 306.

In an example, the first projection 1200 and the first groove 1202 of the chute assembly 306 provide for the sliding movement of the lock pin 108 to be confined between the first projection 1200 and the first groove 1202 in the X direction. For instance, when the detection pins 400-1 and 400-2 are moved out of the slots 900-1 and 900-2 and the lock pin 108 is free to slide on the chute assembly 306, the first projection 1200 and the first groove 1202 define end points for sliding of the lock pin 108 in the X direction. The end points correspond to the first position and the second position of lock pin 108.

Figure 13A:
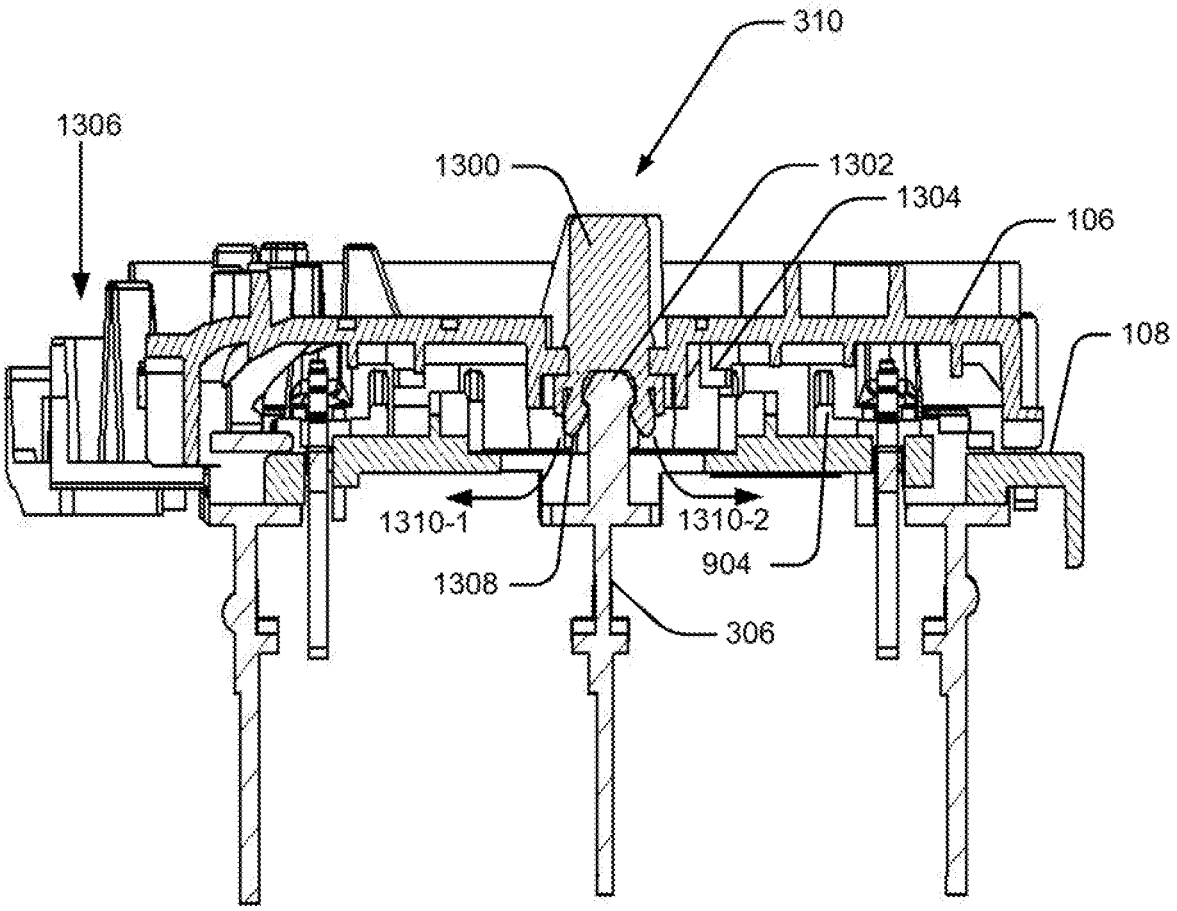
FIGS. 13A and 13B illustrate a manifold latched with the chute assembly in the first position and the second position of the lock pin, respectively, according to an example implementation of the present subject matter.
Figure 13B:
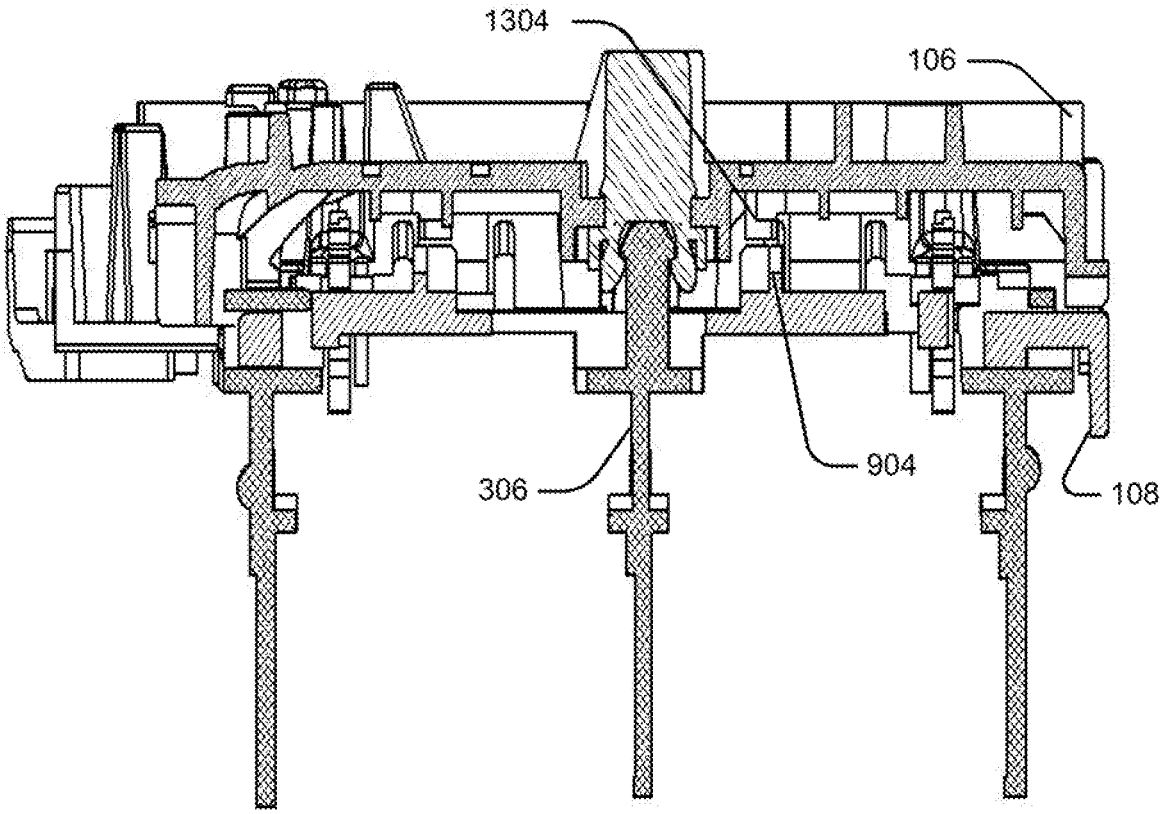

In the first position, the first downward movement of the manifold 106 in the Y direction may be performed to allow latching of the manifold 106 with the chute assembly 306 and the second downward movement of the manifold 106 in the Y direction may be performed to allow unlatching the manifold 106 from the chute assembly 306. In the second position, the first downward movement of the manifold 106 in the Y direction may be performed to allow latching of the manifold 106 with the chute assembly 306, however, the second downward movement of the manifold 106 in the Y direction to unlatch the manifold 106 from the chute assembly 306 is restricted. Reference is made to FIGS. 13A and 13B to elaborate.

FIGS. 13A and 13B illustrate the manifold 106 latched with the chute assembly 306 in the first position and the second position of the lock pin 108, respectively, in accordance with an example implementation of the present subject matter.

Reference is made to FIG. 13A that shows the manifold 106 latched with the chute assembly 306 with the lock pin 108 in the first position, in accordance with an example implementation of the present subject matter. In an example, to latch the manifold 106 with the chute assembly 306 the latching device 310 is used. In an example, the latching device 310 is a push-push latch or a push-open latch. The latching device 310 comprises a latching member 1300 provided on the manifold 106 to engage with a projection member 1302 provided on the chute assembly 306 to latch the manifold 106 with the chute assembly 306.

In an example implementation, a first downward movement, in a direction depicted by an arrow 1306, of the manifold 106 towards the chute assembly 306 causes the latching member 1300 to engage with the projection member 1302. A second downward movement, i.e., a further downwards movement in the direction depicted by the arrow 1306 of the manifold 106 towards the chute assembly 306, causes the latching member 1300 to disengage from the projection member 1302 to unlatch the manifold 106 from the chute assembly 306. In an example, as mentioned previously, the latching device 310 may be a push-push latch or a push-open latch that enables push-open operations in devices. In an example, upon the second downward movement of the latching device 310, internal components (not shown) of the latching device 310 may cause a clasp 1308 of the latching member 1300 to move in an outward direction, shown by arrows 1310-1 and 1310-2. The movement of the clasp 1308 may cause the latching member 1300 to release the projection member 1302.

In an example, the manifold 106 also comprises a latch stopper 1304. The latch stopper 1304 projects downwards in the Y direction along the direction of movement of the manifold 106 towards the chute assembly 306. As shown in FIG. 13A, in the first position, the latch stopper 1304 is offset with respect to the latch locker 904 of the lock pin 108.

However, when the lock pin 108 is in the second position, as shown in FIG. 13B, the latch stopper 1304 of the manifold 106 aligns with the latch locker 904 of the lock pin 108 in the Y direction. In an example, a height of the latch locker 904 and the latch stopper 1304 is such that there exists no distance between the two when the two align in the second position of the lock pin 108, thus blocking the movement of the manifold 106 in the Y direction.

Accordingly, when the manifold 106 is latched with the chute assembly 306 with the lock pin 108 in the second position, the latch locker 904 and the latch stopper 1304 abut in the second position of the lock pin 108 to block the second downward movement of the manifold 106. Consequently, the manifold 106 may not be unlatched from the chute assembly 306 as long as the lock pin 108 is in the second position. In an example implementation, the lock pin 108 may automatically, or in other words, without any user intervention, slide to the second position where it restricts unlatching of the manifold 106, i.e., locks the manifold 106.

In an example, a user may perform an initial installation process to set-up the printing device 100 for operation. In the initial installation process, the printheads 110-1 and 110-2 may be inserted in the openings 104-1 and 104-2, respectively. Insertion of the printheads 110-1 and 110-2 in the openings 104-1 and 104-2, respectively, disengage the detection pins 400-1 and 400-2 from the lock pin 108, such that the lock pin 108 is rendered free to slide on the chute assembly 306 Thereupon, the manifold 106 may be closed, or, in other words, the manifold 106 may be latched with the chute assembly 306.

Once the manifold 106 is latched, the carriage assembly 112 is moved by a controller (not shown) of the printing device 100. In an example, the sliding of the lock pin 108 from the first position and the second position, to lock the manifold 106, is triggered by the movement of the carriage assembly 112 by the controller.

In an example, the controller may detect insertion of the printheads 110-1 and 110-2 and may determine health of the printheads 110-1 and 110-2 prior to moving the carriage assembly 112. Such a measure by the controller ensures that the manifold 106 is not locked if either of the printheads 110-1 and 110-2 are faulty. In an example, when the printheads 110-1 and 110-2 are detected to be functional, the controller may issue a command to move the carriage assembly 112 to an end position within a print zone of the printing device 100. In an example implementation, in the end position, the lock pin 108 abuts a housing member (shown later, see housing member 1400 in FIG. 14) of the printing device 100 to slide from the first position to the second position.

Figure 14:
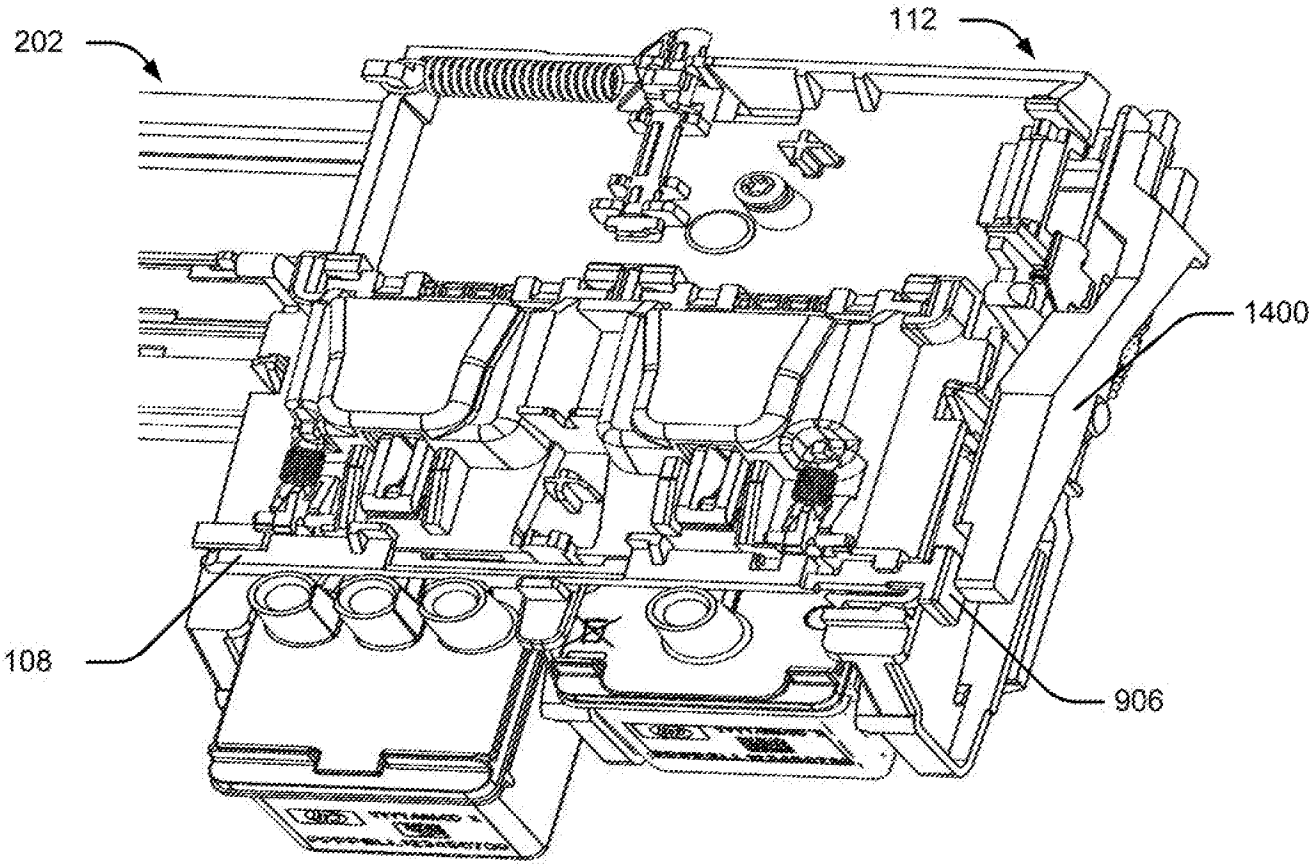
FIG. 14 shows a carriage assembly at an end position within a print zone of the printing device, in accordance with an example implementation of the present subject matter.

Reference is made to FIG. 14 that shows the carriage assembly 112 at an end position within a print zone of the printing device 100, in accordance with an example implementation of the present subject matter. When the carriage assembly 112 is moved to the end position, the end member 906 of the lock pin 108 collides with the housing member 1400 of the printing device 100. In an example, the housing member 1400 may be an end support member of the hanger assembly 202 on which the carriage assembly 112 is mounted to enable the movement of the carriage assembly 112 in the print zone of the printing device 100. The interfacing of the end member 906 with the end support member 1400 pushes the lock pin 108 inwards in the X direction thereby causing the lock pin 108 to slide from the first position to the second position.

In an example, to avoid inadvertent unlatching of the manifold 106, the lock pin 108 is maintained in the second position where the manifold 106 is locked. To unlock the manifold 106, for example, for servicing or replacement of the printhead 110, an unlocking action may be performed by the user.

Figure 15:
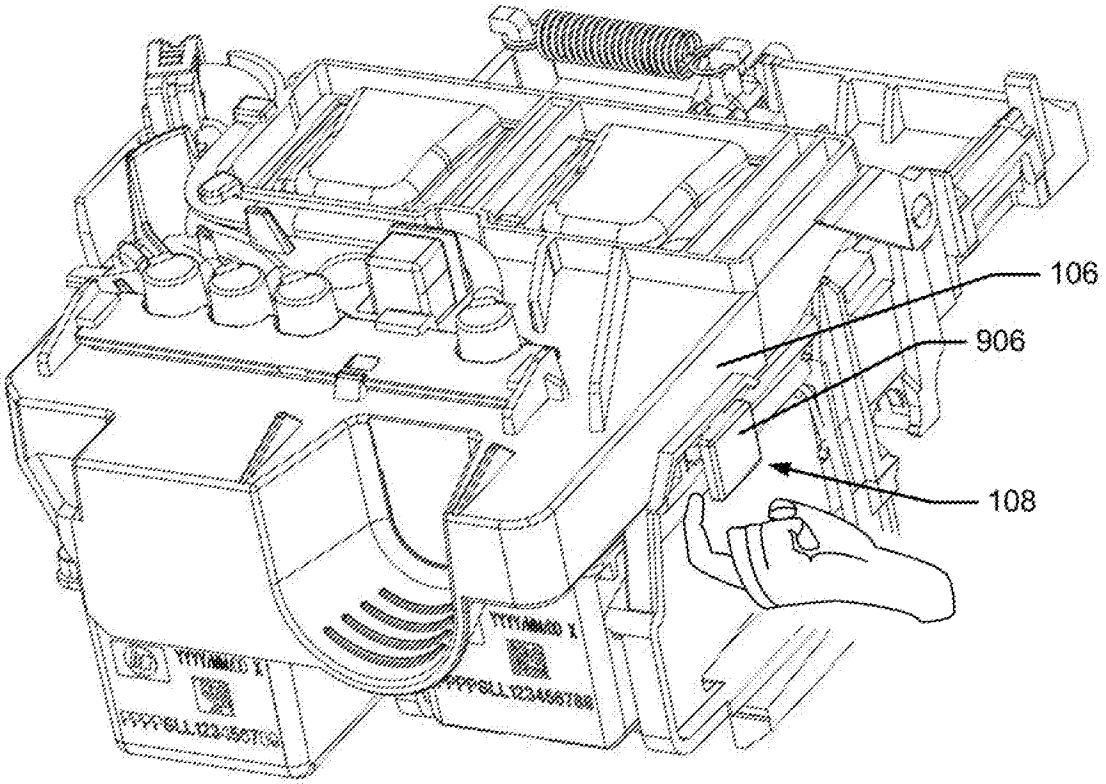
FIG. 15 depicts a manifold in a locked state, according to an example implementation of the present subject matter.

The unlocking of the manifold 106 of the printing device 100, is explained in reference to FIG. 15 (and referring back to FIGS. 12A and 12B) which depicts the manifold 106 in a locked state according to an example implementation of the present subject matter. In an example implementation, the hooking member 908 of the lock pin 108 is operable to unlock the manifold 106. When the user pulls the end member 906 of the lock pin 108, the hooking member 908 of the lock pin 108 may move out of the first groove 1202 and engage with the first projection 1200 provided on the chute assembly 306. The first groove 1202 and the first projection 1200 have been shown in FIG. 12A and are not visible in FIG. 15. As a result, the lock pin 108 moves from the second position to the first position.

In accordance with an example implementation of the present subject matter, locking of the manifold 106 with the carriage structure 102 to restrict access to the printhead 110 is obscured from users. For example, once the user has performed an initial installation process to install a printhead 110 in the opening 104 and has closed the manifold 106, the carriage assembly 112 is moved by the controller of the printing device 100 to cause the sliding of the lock pin 108 from the first position to the second position. Accordingly, as the sliding of the lock pin 108 from the first position to the second position is independent of an action performed by a user, the user may not be made aware with regards to unlocking of the manifold 106. Thus, a novice user who may attempt to unlock of the manifold 106 may be deterred to prevent air entrainment in the CISS 200 (described in FIG. 2).

In an example, the unlocking of the manifold 106 may be performed, for example, by a user or a service personnel, who is made aware of instructions to unlock the manifold 106, for example, based on a service manual of the printing device 100. The unlocking of the manifold 106 allows the manifold 106 to unlatch from the carriage structure 102 such that the printhead 110 may be accessed, for example, for servicing or replacement while the locked state of the manifold 106 provides for instances of accidental unlatching of the manifold 106 to be minimized.

The incorporation of the lock pin 108 in the printing device 100 does not affect the serviceability of the printing device 100 as unlocking of the manifold 106 may be performed by a user without any significant efforts and without any tools.

Thus, the methods and devices of the present subject matter provide techniques to restricts unlatching of the manifold from the carriage structure in a printing device. Although examples lock pin and the detection pin, have been described in a language, specific to structural features and/or methods, it is to be understood that the appended claims are not necessarily limited to the specific features or methods described. Rather, the specific features and methods are disclosed as example techniques for restricting unlatching of the manifold.

The invention claimed is:

1. A printing device comprising:

a carriage assembly to move within the printing device, the carriage assembly comprising:

a carriage structure defining an opening to house a printhead;

a manifold coupled to the carriage structure, wherein the manifold is to cover the printhead in a latched position and allow access to the printhead in an unlatched position; and a lock pin mounted on the carriage structure, the lock pin being slideable to a first position and a second position with respect to the manifold along the carriage structure, the lock pin to restrict unlatching of the manifold with the carriage structure in the second position.

2. The printing device as claimed in claim 1, further comprising:

a detection pin provided in the carriage structure, the detection pin to move from a block position to a release position on insertion of the printhead in the opening, wherein in the block position, the detection pin is to engage with the lock pin in the first position to restrict a sliding of the lock pin to the second position.

3. The printing device as claimed in claim 2, further comprising:

a spring mounted on the carriage structure;

wherein the spring is coupled to the detection pin to move the detection pin to the block position upon removal of the printhead from the opening.

4. A carriage assembly for a printing device, the carriage assembly comprising:

a carriage base to support a printhead;

a chute assembly attachable to the carriage base, the chute assembly comprising an opening to accommodate the printhead; and a manifold coupled to the carriage base to cover the printhead;

a latching device to latch the manifold to the carriage base upon a first downward movement of the manifold towards the carriage base and to unlatch the manifold from the carriage base upon a second downward movement of the manifold towards the carriage base; and a lock pin slidably mounted on the chute assembly, the lock pin being slideable between a first position and a second position with respect to the manifold, the lock pin to restrict the second downward movement of the manifold towards the carriage base in the second position.

5. The carriage assembly as claimed in claim 4, wherein:

the lock pin further comprises a latch locker projecting upwards with respect to a direction of sliding of the lock pin;

the manifold further comprises a latch stopper projecting downwards along a direction of movement of the manifold towards the carriage base, wherein the latch locker and the latch stopper abut in the second position of the lock pin.

6. The carriage assembly as claimed in claim 4, further comprising:

a detection pin movably mounted on the chute assembly, the detection pin to move from a block position to a release position on insertion of the printhead in the opening.

7. The carriage assembly as claimed in claim 6, wherein:

the lock pin further comprises a slot to secure the detection pin in the first position of the lock pin.

8. The carriage assembly as claimed in claim 6, further comprising:

a spring mounted on the chute assembly;

wherein the spring is coupled to a hook of the detection pin to push the detection pin to the block position upon removal of the printhead from the opening.

9. The carriage assembly as claimed in claim 4, wherein the lock pin further comprises a hook operable to move the lock pin from the second position to the first position.

10. A printing device comprising:

a carriage assembly to move within the printing device, the carriage assembly comprising:

a carriage structure defining an opening to house a printhead;

a manifold positioned above the carriage structure, the manifold to latch with the carriage base upon a first downward movement of the manifold towards the carriage base and to unlatch from the carriage base upon a second downward movement of the manifold towards the carriage base;

a lock pin slideable on the carriage structure to a first position and a second position respect to the manifold, wherein the lock pin is to allow unlatching of the manifold with the carriage structure in the first position and restrict unlatching of the manifold with the carriage structure in the second position; and a detection pin mounted in the carriage structure, wherein in the first position of the lock pin, the detection pin is to engage with the lock pin to restrict a sliding of the lock pin to the second position.

11. The printing device as claimed in claim 10, further comprising:

a controller to:

detect insertion of the printhead;

determine health of the printhead; and provide, based on the determined health, a command to move the carriage assembly to an end position within a print zone of the printing device, wherein the detection pin is to disengage with the lock pin on insertion of the printhead.

12. The printing device as claimed in claim 11, wherein in the end position of the carriage assembly, the lock pin is to abut a housing member of the printing device to slide from the first position to the second position.

13. The printing device as claimed in claim 10, wherein the lock pin further comprises a hook, wherein a movement of the hook is to move the lock pin from the second position of the first position.

14. The printing device as claimed in claim 10, further comprising:

a spring mounted on the carriage structure, the spring coupled to the detection pin, wherein, upon removal of the printhead from the opening, the spring is to move the detection pin to a position where the detection pin is to engage with the lock pin.

15. The printing device as claimed in claim 10, wherein:

the lock pin comprises a latch locker projecting towards the manifold; and the manifold further comprises a latch stopper projecting towards the carriage structure, wherein in the second position of the lock pin, the latch locker is to interface with the latch stopper to restrict the movement of the manifold in a downward direction.

* * * * *